US012061054B2

(12) United States Patent
Romlund

(10) Patent No.: US 12,061,054 B2
(45) Date of Patent: Aug. 13, 2024

(54) HEAT EXCHANGER PLATE AND A PLATE HEAT EXCHANGER

(71) Applicant: ALFA LAVAL CORPORATE AB, Lund (SE)

(72) Inventor: Jens Romlund, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 460 days.

(21) Appl. No.: 17/425,454

(22) PCT Filed: Feb. 12, 2020

(86) PCT No.: PCT/EP2020/053589
§ 371 (c)(1),
(2) Date: Jul. 23, 2021

(87) PCT Pub. No.: WO2020/173707
PCT Pub. Date: Sep. 3, 2020

(65) Prior Publication Data

US 2022/0099379 A1 Mar. 31, 2022

(30) Foreign Application Priority Data

Feb. 26, 2019 (SE) ..... 1950244-2

(51) Int. Cl.
*F28D 9/00* (2006.01)
*F28D 21/00* (2006.01)
(Continued)

(52) U.S. Cl.
CPC ..... *F28D 9/005* (2013.01); *F28F 3/046* (2013.01); *F28F 9/028* (2013.01); *F28D 2021/0071* (2013.01)

(58) Field of Classification Search
CPC ..... F28D 9/005; F28D 2021/0071; F28D 9/0043; F28D 9/0056; F28D 9/0075;
(Continued)

(56) References Cited

U.S. PATENT DOCUMENTS 2,550,339 A * 4/1951 Ehrman ..... F28F 3/046 165/167
2,699,324 A * 1/1955 Goodman ..... F28F 3/083 165/167
(Continued)

FOREIGN PATENT DOCUMENTS

CN 102829655 A 12/2012
CN 202869327 U 4/2013
(Continued)

OTHER PUBLICATIONS

Office Action (Notice of Preliminary Rejection) issued Apr. 28, 2023, by the Korean Intellectual Property Office in corresponding Korean Patent Application No. 10-2021-7030617 and an English translation of the Office Action. (9 pages).
(Continued)

*Primary Examiner* — Claire E Rojohn, III
(74) *Attorney, Agent, or Firm* — BUCHANAN INGERSOLL & ROONEY PC

(57) ABSTRACT

A plate heat exchanger and a heat exchanger plate for evaporation of a first fluid are disclosed. The heat exchanger plate comprises a heat exchanger area extending in parallel with an extension plane of the heat exchanger plate and comprising a corrugation of ridges and valleys. An edge area extends around the heat exchanger area. Portholes extend through the heat exchanger area and comprise a first inlet porthole for said first fluid. A peripheral rim surrounds the first inlet porthole and extends transversely to the extension plane from a root end to an edge. The peripheral rim has a circumferential length and comprises a flat or substantially
(Continued)

flat portion. A restriction hole extends through the flat or substantially flat portion.

20 Claims, 3 Drawing Sheets

(51) Int. Cl.
*F28F 3/04* (2006.01)
*F28F 9/02* (2006.01)

(58) Field of Classification Search
CPC ..... F28D 1/0308; F28F 3/046; F28F 9/028; F28F 3/086; F28F 3/02
USPC ..... 165/167
See application file for complete search history.

(56) References Cited

U.S. PATENT DOCUMENTS

| | | | | |
|---|---|---|---|---|
| 4,073,340 | A * | 2/1978 | Parker | F28F 3/027 165/166 |
| 4,310,960 | A | 1/1982 | Parker | |
| 5,162,167 | A * | 11/1992 | Minh | H01M 8/2404 429/456 |
| 7,404,434 | B2 * | 7/2008 | Martin | F28F 9/026 165/167 |
| 8,167,029 | B2 | 5/2012 | Bertilsson et al. | |
| 9,310,136 | B2 | 4/2016 | Andersson et al. | |
| 10,024,602 | B2 * | 7/2018 | Nyander | F28F 3/046 |
| 10,035,207 | B2 * | 7/2018 | Bornegard | F28F 3/086 |
| 11,231,210 | B2 * | 1/2022 | Mizuno | F25B 39/04 |
| 2008/0196874 | A1 * | 8/2008 | Bertilsson | F28D 9/005 165/167 |
| 2008/0283231 | A1 * | 11/2008 | Horte | F28D 9/005 165/167 |
| 2011/0308779 | A1 * | 12/2011 | Andersson | F28D 9/005 165/170 |
| 2015/0292803 | A1 * | 10/2015 | Nyander | B23P 15/26 29/890.03 |
| 2015/0316330 | A1 * | 11/2015 | Kenney | F28D 9/0056 165/167 |
| 2019/0033005 | A1 * | 1/2019 | Romlund | C22C 19/056 |
| 2019/0145711 | A1 * | 5/2019 | Mohammadian | F28F 9/026 165/134.1 |

FOREIGN PATENT DOCUMENTS

| | | | | |
|---|---|---|---|---|
| CN | 206818032 | U | 12/2017 | |
| CN | 109154475 | A | 1/2019 | |
| EP | 2730878 | A1 | 5/2014 | |
| GB | 134277 | A | 10/1919 | |
| GB | 1 471 212 | A | 4/1977 | |
| GB | 2056648 | A | 3/1981 | |
| JP | S50-008134 | A | 1/1975 | |
| JP | 2007-518056 | A | 7/2007 | |
| JP | 2013178078 | A | 9/2013 | |
| JP | 2016-502059 | A | 1/2016 | |
| TW | 336272 | B | 7/1998 | |
| TW | 201437593 | A | 10/2014 | |
| TW | I628405 | B | 7/2018 | |
| WO | 9715797 | A1 | 5/1997 | |
| WO | 2005/066572 | A1 | 7/2005 | |
| WO | 2014/065742 | A1 | 5/2014 | |
| WO | 2017174301 | A1 | 10/2017 | |
| WO | 2017207292 | A1 | 12/2017 | |
| WO | WO-2017207292 | A1 * | 12/2017 | F28D 9/005 |

OTHER PUBLICATIONS

English Translation of the Office Action (Notice of Reasons for Rejection) issued Aug. 29, 2022, by the Japan Patent Office in corresponding Japanese Patent Application No. 2021-547236. (3 pages).

International Search Report (PCT/ISA/210) and Written Opinion (PCT/ISA/237) mailed on May 13, 2020, by the European Patent Office as the International Searching Authority for International Application No. PCT/EP2020/053589.

* cited by examiner

Fig 4
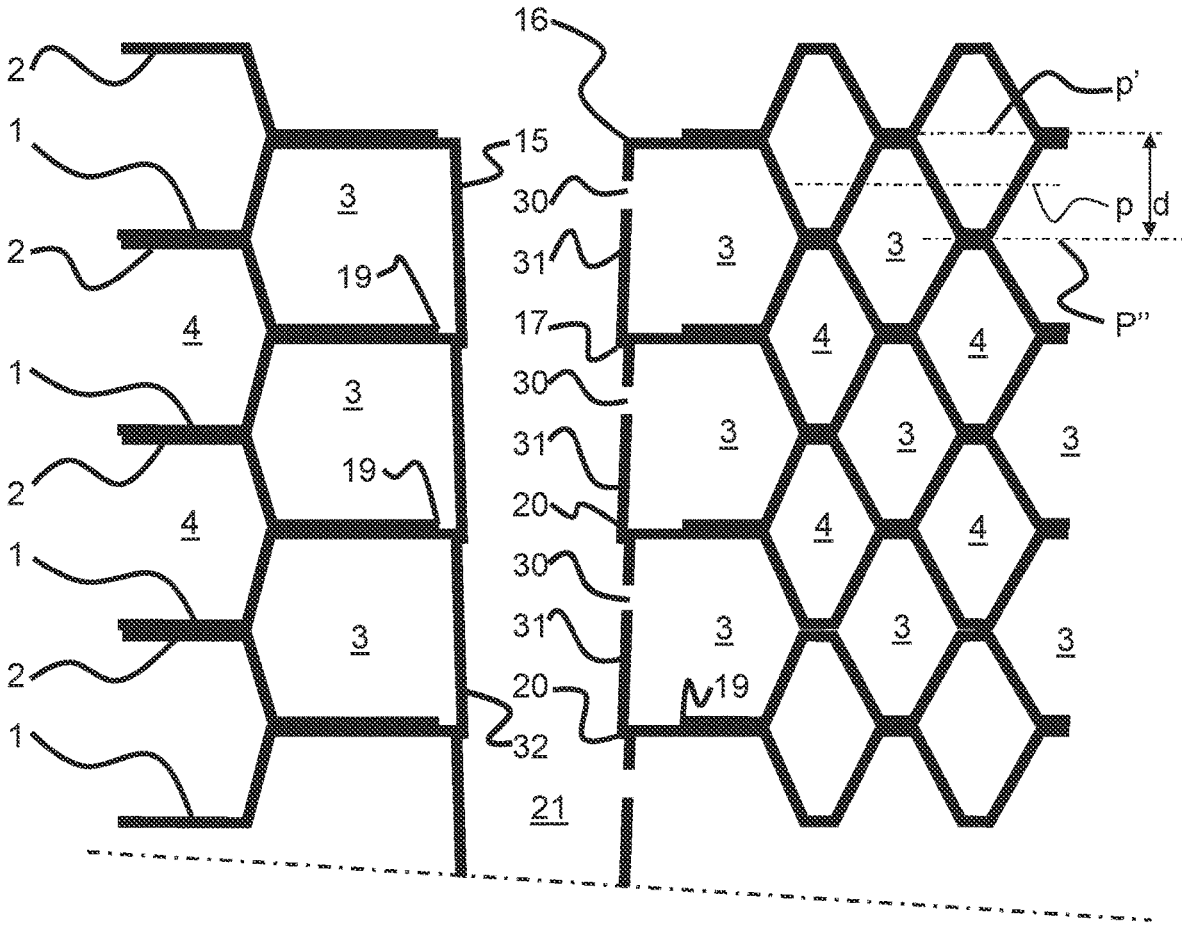
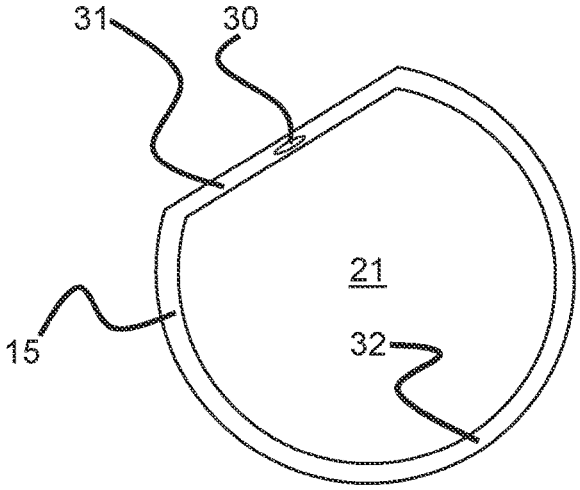
Fig 5

HEAT EXCHANGER PLATE AND A PLATE HEAT EXCHANGER

TECHNICAL FIELD OF THE INVENTION

The present invention refers to a heat exchanger plate according to the preamble of claim 1. The invention also refers to a plate heat exchanger comprising a plurality of heat exchanger plates. The plate heat exchanger may be configured to operate as an evaporator.

BACKGROUND OF THE INVENTION AND PRIOR ART

WO 2017/174301 discloses a heat exchanger plate, a plate heat exchanger for evaporation of a first fluid, and a method of making a plate heat exchanger are disclosed. The heat exchanger plate comprises a heat exchanger area extending in parallel with an extension plane the heat exchanger plate, an edge area extending around the heat exchanger area, a number of portholes extending through the heat exchanger area, and a peripheral rim surrounding a first porthole of said number of portholes and extending transversely to the extension plane from a root end to a top end with a rim height perpendicular to the extension plane. The heat exchanger plate comprises at least one restriction hole extending through the peripheral rim and having a height perpendicular to the extension plane.

WO 2017/207292 discloses a plate heat exchanger comprising first heat exchanger plates, second heat exchanger plates, first plate interspaces each formed by a primary pair of one second heat exchanger plate and an adjacent first heat exchanger plate, and second plate interspaces each formed by a secondary pair one first heat exchanger plate and an adjacent second heat exchanger plates. Each first heat exchanger plate comprises a peripheral rim surrounding a first porthole and defining an inlet channel for a first fluid through the plate heat exchanger. Each secondary pair encloses an inlet chamber adjacent to the peripheral rim. The inlet chamber is closed to the second plate interspaces, open to the inlet channel and communicates with one of the first plate interspaces via a nozzle member, thereby permitting a flow of the first fluid from the inlet channel to the first plate interspace.

U.S. Pat. No. 9,310,136 discloses a brazed plate heat exchanger for exchanging heat between fluids, comprising a number of heat exchanging plates provided with a pressed corrugation of ridges and grooves. The heat exchanger plates are stacked onto one another such that flow channels are formed between said plates. The flow channels are in selective communication with port openings. Port skirts are arranged on the heat exchanging plates. The port skirts at least partly surround the port openings, extend in a generally perpendicular direction as compared to a plane of the heat exchanger plates and are arranged to overlap one another to form a pipe like configuration or a part thereof.

Due to the deformation of the material, a large strain may arise in the material when forming, through pressing, the heat exchanger plate and the peripheral rim, especially at the edge of the peripheral rim. In evaporators, for instance those described in the documents referred to above, it is desired to have a relatively small flow area for the porthole forming the inlet for the refrigerant, being in a liquid state. Such small flow area further increases the strain in the peripheral rim. A restriction hole through the peripheral rim subjected to a large strain, may cause problems with the strength of the peripheral rim, and may render the peripheral rim sensible to cracking especially close to the edge of the peripheral rim.

SUMMARY OF THE INVENTION

The purpose of the present invention is thus to remedy the problems discussed above, and to provide a plate heat exchanger having an improved strength in the area of the porthole, especially the inlet porthole for a refrigerant.

The purpose is achieved by the heat exchanger plate initially defined, which is characterized in that that the peripheral rim, along the circumferential length, comprises a flat or substantially flat portion and that the restriction hole extends though the flat or substantially flat portion.

The flat or substantially flat portion may thus be flat or plane, or may have a slight curvature along the circumferential length.

The flat or substantially flat portion of the peripheral rim comprises no stresses, or substantially no stresses, meaning that the strain is significantly lower than in a remaining portion or remaining portions of the peripheral rim, especially in the proximity of the edge of peripheral rim. The risk of cracks on the peripheral rim due to the restriction hole is therefore significantly lower than when the restriction hole extends through a curved peripheral rim. Consequently, the strength of the claimed heat exchanger plate, especially in the area of the inlet porthole for the fluid to be evaporated, is improved.

According to an embodiment of the invention, the peripheral rim is formed by said at least one flat or substantially flat portion and at least one remaining portion, which may have a radius of curvature that varies along the circumferential length. The radius of curvature of said at least one remaining portion may be shorter than the radius of curvature of the flat or substantially flat portion in each position along the circumferential length.

According to an embodiment of the invention, the flat or substantially flat portion of the peripheral rim extends transversely to the extension plane of the heat exchanger plate.

According to an embodiment of the invention, the flat or substantially flat portion has a length measured in parallel with the extension plane of the heat exchanger plate that is at least 5% of the circumferential length, preferably at least 10% of the circumferential length, or more preferably at least 15% of the circumferential length. Advantageously, said length may be at most 50% of the circumferential length of the peripheral rim.

According to an embodiment of the invention, the restriction hole is located more closely to the root end than to the edge of the peripheral rim. This location of the restriction hole contributes to the strength of the peripheral rim and the first inlet porthole.

According to an embodiment of the invention, the restriction hole has a diameter that is at least 0.5 mm. The diameter of the restriction hole creates a restriction for the first fluid that is sufficient to create a pressure drop and a proper distribution of the first fluid in the plate interspace inside the restriction hole. The exact length of the diameter of the restriction hole may be determined by factors such as the type of refrigerant selected to form the first fluid.

According to an embodiment of the invention, the flat or substantially flat portion is turned towards a central line of the heat exchanger area. Such a position of the flat or substantially flat portion and thus the restriction hole may direct the first fluid towards the heat exchanger area. However, the flat or substantially flat portion may also be turned in another direction, for instance towards a short side of the heat exchanger plate or towards a long side of the heat exchanger plate.

According to an embodiment of the invention, the peripheral rim comprises two flat or substantially flat portions, wherein a respective restriction hole extends through each of the flat or substantially flat portions. The number of the flat or substantially flat portions, and thus the number of restriction holes, may thus be one, two, three, four or even more. The number of the flat or substantially flat portions and restriction holes is determined by factors such as the type of refrigerant selected to form the first fluid. Consequently, the flat or substantially flat portions may be turned in different directions including, for instance, towards the central line of the heat exchanger area.

Each of the restriction holes may be located more closely to the root end then to the outer end of the peripheral rim.

Each of the restriction holes may have a diameter that is at least 0.5 mm or being in accordance with the examples given above.

The length of each of the flat or substantially flat portions, measured in parallel with the extension plane of the heat exchanger plate, may be is at least 5% of the circumferential length, preferably at least 10% of the circumferential length, or more preferably at least 15% of the circumferential length. Advantageously, the sum of said lengths of the flat or substantially flat portions may be at most 50% of the circumferential length of the peripheral rim.

According to an embodiment of the invention, the portholes has a respective flow area and comprises a first outlet porthole for said first fluid, wherein the flow area of the first inlet porthole may be smaller, or significantly smaller, than the flow area of the first outlet porthole, especially the flow area of the first inlet porthole is less than 50% of the flow area of the first outlet porthole. Such a smaller flow area generally increases the strain in the peripheral rim, especially at the edge of the peripheral rim. Thus, the flat or substantially flat portion may in this case in an efficient manner reduce the strain and provide a proper position for the restriction hole.

According to an embodiment of the invention, the ridges and valleys extend between a primary level at a distance from the main extension plane and a secondary level at a distance from and on an opposite side of the main extension plane, wherein the heat exchanger plate has a pressure depth defined by the distance between the primary level and the secondary level, and wherein the peripheral rim may have a length perpendicularly to the main extension plane that is longer than twice the pressure depth. Such a length of the peripheral rim permit an overlap joint between the outer end of the peripheral rim of the heat exchanger plates and the root end of the peripheral rim of another heat exchanger plate.

The purpose is also achieved by the plate heat exchanger initially defined, wherein the plurality of heat exchanger plates comprises first heat exchanger plates, each of which constitutes a heat exchanger plate as described above, and second heat exchanger plates.

According to an embodiment of the invention, wherein the first and second heat exchanger plates are arranged in an alternating order in a plate package of the plate heat exchanger to form first plate interspaces for the first fluid to be evaporated and second plate interspaces for a second fluid.

According to an embodiment of the invention, the portholes of the first and second heat exchanger plates form an inlet channel for the first fluid, an outlet channel for the first fluid, an inlet channel for the second fluid, and an outlet channel for the second fluid, respectively. The inlet channel for the first fluid may have a flow area that is smaller, or significantly smaller, than the flow area of the outlet channel for the first fluid.

According to an embodiment of the invention, the restriction hole extends through the flat or substantially flat portion of the peripheral rim of the first heat exchanger plate from the inlet channel for the first fluid to one of the first plate interspaces.

According to an embodiment of the invention, the outer end of the peripheral rim of one of the first heat exchanger plates and the root end of the peripheral rim of an adjacent first heat exchanger plate overlap each other and form an overlap joint, especially a brazed overlap joint.

BRIEF DESCRIPTION OF THE DRAWINGS

The present invention is now to be explained more closely through a description of various embodiments and with reference to the drawings attached hereto.

FIG. 4 discloses schematically a sectional view of a part of an inlet channel of the plate heat exchanger in FIG. 1.

FIG. 5 discloses schematically a view from above of a first inlet porthole of the first heat exchanger plate in FIG. 3.

DETAILED DESCRIPTION OF VARIOUS EMBODIMENTS

Figure 1:
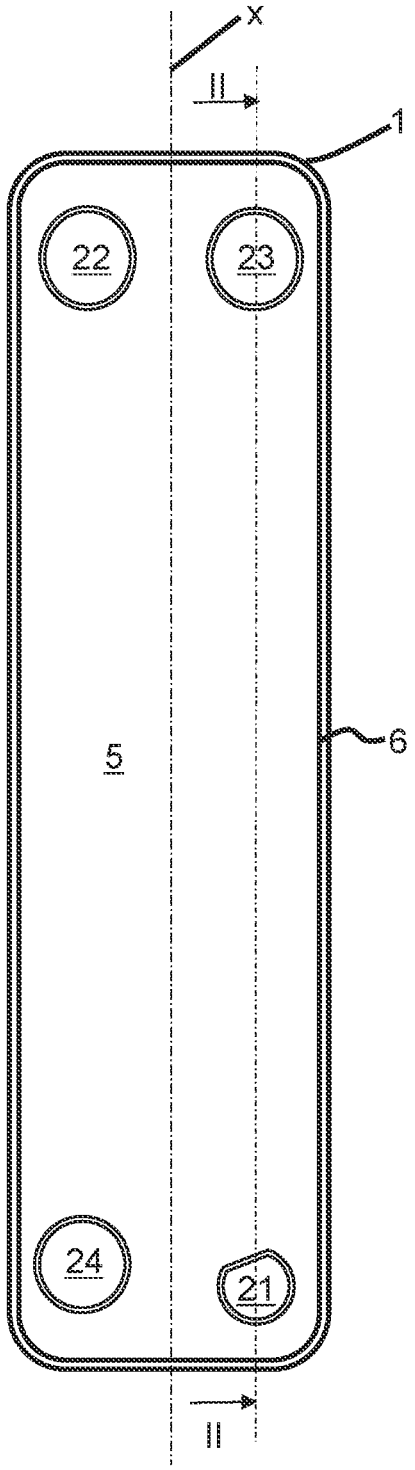
FIG. 1 discloses schematically a plan view of a plate heat exchanger according to an embodiment of the invention.
Figure 2:
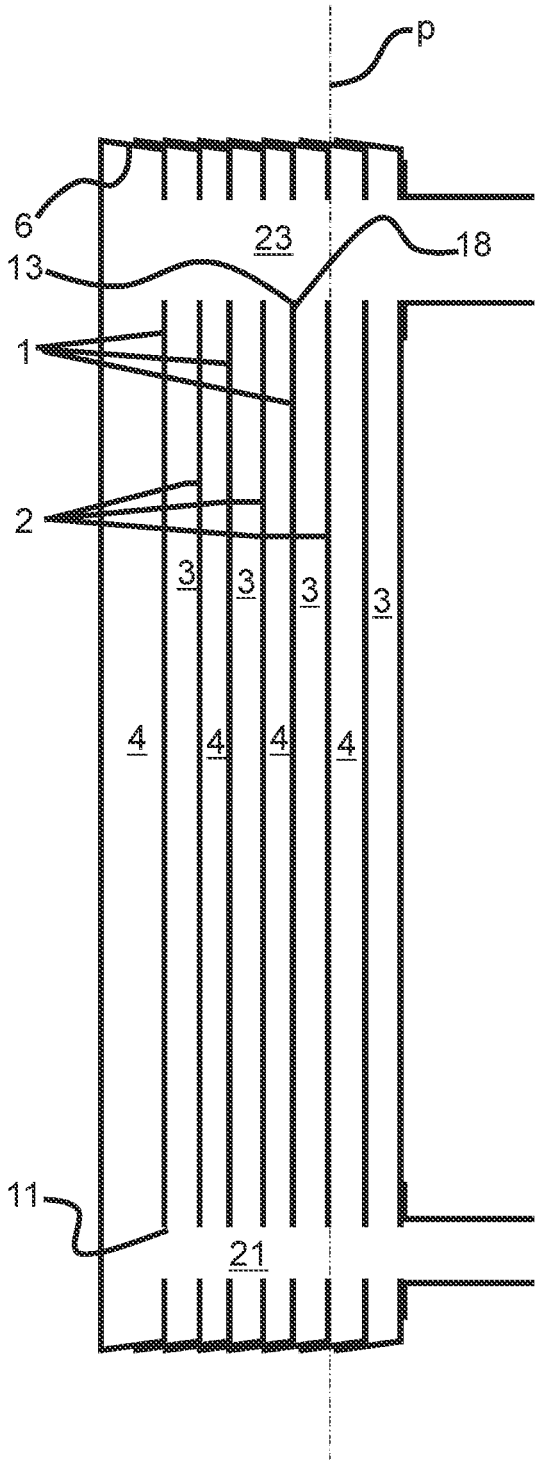
FIG. 2 discloses schematically a longitudinal sectional view along the line II-II in FIG. 1.

FIGS. 1 and 2 disclose a plate heat exchanger comprising a plurality of heat exchanger plates 1, 2 arranged in a plate package of the plate heat exchanger. The heat exchanger plates 1, 2 comprise first heat exchanger plates 1 and second heat exchanger plates 2. Each of the first heat exchanger plates 1 and the second heat exchanger plates 2 extends in parallel with a respective extension plane p.

As can be seen in FIG. 2, the first and second heat exchanger plates 1, 2 are arranged side by side in an alternating order in such in a way that first plate interspaces 3 for a first fluid is formed between each pair of adjacent first and second heat exchanger plates 1, 2, and second plate interspaces 4 for a second fluid between each pair of adjacent second and first heat exchanger plates 2, 1. The first plate interspaces 3 and the second plate interspaces 4 are provided side by side in an alternating order in the plate heat exchanger.

The heat exchanger plates 1, 2 of the plate package may be joined to each other by a brazing material obtained through brazing process in a known manner.

The plate heat exchanger is configured to be operated as an evaporator, wherein the first plate interspaces 3 are configured to receive the first fluid to be evaporated therein. The first fluid may be any suitable refrigerant. The second plate interspaces 4 are configured to receive the second fluid for heating the first fluid to be evaporated in the first plate interspaces 3.

Figure 3:
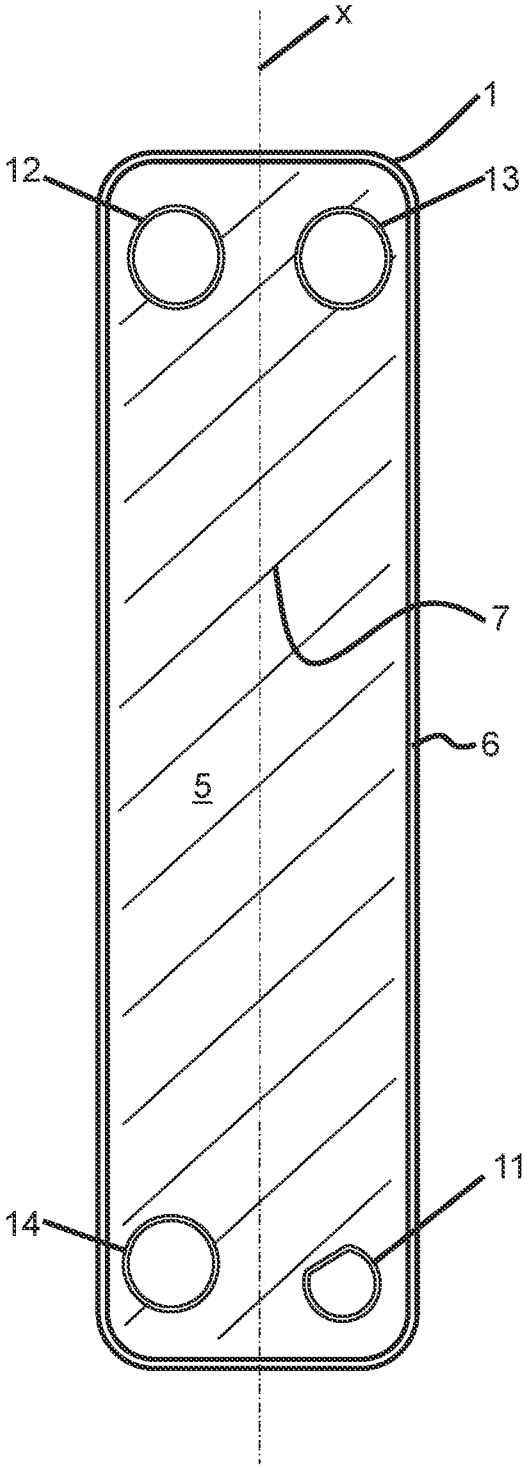
FIG. 3 discloses schematically a plan view of a first heat exchanger plate of the plate heat exchanger in FIG. 1.

Each of the first and second heat exchanger plates 1, 2 has a heat exchanger area 5, see FIG. 3, extending in parallel with the extension plane p, and an edge area 6 extending around the heat exchanger area 5. The edge area 6 thus surrounds the heat exchanger area 5 and forms a flange which is inclined in relation to the extension plane p, see FIG. 2. The flange of the edge area 6 of one of the heat exchanger plates 1, 2 adjoins, and is joined, especially brazed, to a corresponding flange of an edge area 6 of an adjacent one of the heat exchanger plates 1, 2, in a manner known per se.

The heat exchanger area 5 comprises a corrugation 7 of ridges and valleys, which is schematically indicated in FIG. 3. The corrugation 7 may form various patterns, for instance a diagonal pattern, a fishbone pattern, etc. as is known in the art of plate heat exchangers.

The ridges and valleys of the corrugation 7 extend between a primary level p' at a distance from the main extension plane p and a secondary level p" at a distance from and on an opposite side of the main extension plane p, see FIG. 4. The heat exchanger plate has a pressure depth d defined by the distance between the primary level p' and the secondary level p".

Each of the first heat exchanger plates 1 and the second heat exchanger plates 2 also comprises four portholes 11, 12, 13, 14, see FIG. 3, a first inlet porthole 11, a first outlet porthole 12, a second inlet porthole 13 and a second outlet porthole 14. Each of the portholes 11-14 has a respective flow area.

In the embodiment disclosed in the figures, the first inlet porthole 11 has a flow area that is smaller, or significantly smaller, than the flow area of the first outlet porthole 12, for instance less than 50% of the flow area of the first outlet portholes 12. The dimension of the flow area of the second inlet porthole 13 and the second outlet porthole 14 depends on the properties of the second fluid.

As can be seen in FIG. 4, the first inlet porthole 11 of the first heat exchanger plates 1 is surrounded by a peripheral rim 15. The peripheral rim 15 has a root end 16 and an edge 17. The peripheral rim 15 has a rim height H perpendicularly to the extension plane p from the root end 16 to the edge 17. The height H may be longer than twice the pressure depth d, or longer than the sum of the pressure depth d of two adjacent heat exchanger plates 1, 2.

The peripheral rim 15 is tapering conical, or slightly tapering or slightly conical, and extends away from the heat exchanger area 5 transversally to the extension plane p. The peripheral rim 15 tapers from the root end 16 towards the edge 17.

The remaining three portholes 12-14 are not provided with any peripheral rim of the kind provided at the first inlet porthole 11, but are defined by a porthole edge 18, schematically indicated in FIG. 2 for the portholes 13.

Moreover, the first inlet porthole 11 of the second heat exchanger plates 2 lacks any peripheral rim, as can be seen in FIG. 4. The first inlet porthole 11 of the second heat exchanger plates 2 is defined by a porthole edge 19.

The first and second heat exchanger plates 1, 2 are arranged in such a way that the peripheral rim 15 of the first heat exchanger plates 1 define an inlet channel 21, see FIGS. 1 and 4, extending through the plate heat exchanger. The peripheral rim 15 passes the adjacent second heat exchanger plate 2 before reaching the adjacent first heat exchanger plate 1. The edge 17 of the peripheral rim 15 of the first heat exchanger plates 1 overlaps and is joined to the root end 16 of the peripheral rim 15 of the adjacent first heat exchanger plate 1 to form an overlap joint 20. The edge 17 of the peripheral rim 15 of the first heat exchanger plates 1 may thus be brazed to the root end 16 of the peripheral rim 15 of the adjacent first heat exchanger plate 1 at the overlap joint 20.

The first outlet porthole 12 of the first and second heat exchanger plates 1, 2 defines an outlet channel 22 for the first fluid, see FIG. 1. The second inlet porthole 13 of the first and second heat exchanger plates 1, 2 defines an inlet channel 23 for the second fluid. The second outlet porthole 14 of the first and second heat exchanger plates 1, 2 defines an outlet channel 24 for the second fluid.

In the embodiment disclosed, each of the first heat exchanger plates 1 comprises a restriction hole 30, which extends through the peripheral rim 15 from the inlet channel 21 to one of the first plate interspaces 3.

The peripheral rim 15 has circumferential length around the first inlet porthole 11. In the embodiment disclosed in the figures, the peripheral rim 15 comprises or consists of, along the circumferential length, a flat or substantially flat portion 31 and a remaining portion 32, having a radius of curvature. The flat or substantially flat portion 31 may thus be flat or may have a radius of curvature that is longer, or significantly longer, than the radius of curvature of the remaining portion 32, i.e. a slight curvature. The restriction hole 30 extends though the flat or substantially flat portion 31 of the peripheral rim 15, see FIGS. 4 and 5.

The flat or substantially flat portion 31 of the peripheral rim 15 extends transversely to the extension plane p of the first heat exchanger plate 1.

The peripheral rim 15 thus may consist of the remaining portion 32, which may form a curved circular portion, and said flat or substantially flat portion 31. The remaining portion 32 may have a constant radius of curvature in each plane parallel with the extension plane p, or the radius of curvature of the remaining portion 32 may vary along the circumferential length of the remaining portion 32. The remaining portion 32 and the flat or substantially flat portion 31 may both be inclined, or slightly inclined, in relation to a line perpendicular to the extension plane p, and thus contribute to the taper of the peripheral rim 15.

The flat or substantially flat portion 31 has a length measured in parallel with the extension plane p of the first heat exchanger plate 1 that is at least 5% of the circumferential length. Preferably said length may be at least 10% of the circumferential length, or more preferably at least 15% of the circumferential length.

Advantageously, said length may be at most 50% of the circumferential length of the peripheral rim.

The restriction hole 30 may be located more closely to the root end 16 then to the edge 17 of the peripheral rim 15, as has been indicated in FIG. 4.

The restriction hole 13 may be circular, or approximately circular, and have a diameter that is at least 0.5 mm, at least 0.7 mm, or at least 1.0 mm. The diameter of the restriction hole may be smaller than 3 mm, or smaller than 2 mm.

In the embodiment disclosed in the figures, the flat or substantially flat portion 31 is turned towards a central line x of the heat exchanger area 5. The central line x extends in parallel with two long sides of the first heat exchanger plate 1, see FIG. 3.

In another embodiment, the flat or substantially flat portion 31 may be turned in another direction, for instance towards a short side of the first heat exchanger plate 1 or towards a long side of the first heat exchanger plate 1.

In the embodiment disclosed in the figures, the peripheral rim 15 comprises only one flat or substantially flat portion 31 with one restriction hole 30. In another embodiment, the sole flat or substantially flat portion 31 may comprise more than one restriction hole 30, for instance two restriction holes 30. In a further embodiment, the peripheral rim 15 may comprise two or more flat or substantially flat portions 31, being distributed along the peripheral rim 15 and each comprising one or more restrictions holes 30. In this case, the flat or substantially flat portions 31 may be turned in different directions including, for instance, towards the central line x of the heat exchanger area 5.

In particular, the peripheral rim 15 may comprise four flat or substantially flat portions 31 arranged perpendicular to each other to form a square- or rectangular-like first inlet porthole 11, wherein the four remaining portions 31 each may form a corner with a short, or very short, radius of curvature. Further shapes of the first inlet porthole 11 are possible, such as triangular, pentagonal etc.

The shape of the remaining portion 32 in the embodiment disclosed in the figures may deviate from a circular shape with a constant radius of curvature, and may thus be oval, elliptic, or irregular.

The present invention is not limited to the embodiments disclosed but may be varied and modified within the scope of the following claims.

The invention claimed is:

1. A heat exchanger plate configured to be comprised by a plate heat exchanger configured for evaporation of a first fluid, the heat exchanger plate comprising a heat exchanger area extending in parallel with an extension plane of the heat exchanger plate and comprising a corrugation of ridges and valleys, an edge area extending around the heat exchanger area (5), a number of portholes extending through the heat exchanger area, the portholes comprising a first inlet porthole for said first fluid, a peripheral rim surrounding the first inlet porthole and extending transversely to the extension plane from a root end of the peripheral rim to an edge of the peripheral rim, wherein the peripheral rim has a circumferential length around the first inlet porthole, and at least one restriction hole extending through the peripheral rim, wherein the peripheral rim, along the circumferential length, comprises at least one flat or substantially flat portion, the at least one flat or substantially flat portion of the peripheral rim being at a location between the root end of the peripheral rim and the edge of the peripheral rim, the restriction hole extending through the flat or substantially flat portion of the peripheral rim.

2. The heat exchanger plate according to claim 1, wherein the flat or substantially flat portion of the peripheral rim extends transversely to the extension plane of the heat exchanger plate.

3. The heat exchanger plate according to claim 1, wherein the flat or substantially flat portion has a length measured in parallel with the extension plane of the heat exchanger plate that is at least 10% of the circumferential length.

4. The heat exchanger plate according to claim 1, wherein the restriction hole is located more closely to the root end then to the edge of the peripheral rim.

5. The heat exchanger plate according to claim 1, wherein the restriction hole has a diameter that is at least 0.5 mm.

6. The heat exchanger plate according to claim 1, wherein the flat or substantially flat portion is turned towards a central line (x) of the heat exchanger area.

7. The heat exchanger plate according to claim 1, wherein the portholes has a respective flow area and comprises a first outlet porthole for said first fluid, and wherein the flow area of the first inlet porthole is smaller than the flow area of the first outlet porthole.

8. The heat exchanger plate according to claim 1, wherein the ridges and valleys of the corrugation extend between a primary level at a distance from the main extension plane and a secondary level at a distance from and on an opposite side of the main extension plane, and wherein the heat exchanger plate has a pressure depth defined by the distance between the primary level and the secondary level, and wherein the peripheral rim has a height perpendicularly to the main extension plane that is longer than twice the pressure depth.

9. A plate heat exchanger comprising a plurality of heat exchanger plates, wherein the plurality of heat exchanger plates comprises first heat exchanger plates, each of which constitutes a heat exchanger plate according to claim 1, and second heat exchanger plates.

10. The plate heat exchanger according to claim 9, wherein the first and second heat exchanger plates are arranged in an alternating order in a plate package of the plate heat exchanger to form first plate interspaces for the first fluid to be evaporated and second plate interspaces for a second fluid.

11. The plate heat exchanger according to claim 10, wherein the portholes of the first and second heat exchanger plates form an inlet channel for the first fluid, an outlet channel for the first fluid, an inlet channel for the second fluid, and an outlet channel for the second fluid, respectively.

12. The plate heat exchanger according to claim 11, wherein the restriction hole extends through the flat or substantially flat-portion of the peripheral rim of the first heat exchanger plate from the inlet channel for the first fluid to one of the first plate interspaces.

13. A plate heat exchanger according to claim 10, wherein the edge of the peripheral rim of one of the first heat exchanger plates overlaps the root end of the peripheral rim of an adjacent first heat exchanger plate to form an overlap joint.

14. The heat exchanger plate according to claim 1, wherein the restriction hole extends through the flat or substantially flat portion of the peripheral rim at a location between the edge of the peripheral rim and the root end of the peripheral rim.

15. A heat exchanger plate for a plate heat exchanger configured to evaporate a first fluid during operation of the plate heat exchanger, the heat exchanger plate comprising:

a heat exchanger area extending in parallel with an extension plane of the heat exchanger plate and comprising a corrugation of ridges and valleys;

an edge area extending around the heat exchanger area;

a number of portholes extending through the heat exchanger area, the portholes comprising a first inlet porthole through which the first fluid flows during the operation of the plate heat exchanger;

a transversely extending peripheral rim surrounding the first inlet porthole and extending transverse to the extension plane from a root end of the peripheral rim located at the first inlet porthole to an edge of the peripheral rim, the peripheral rim having a circumferential length around the first inlet porthole;

at least one restriction hole passing through the transversely extending peripheral rim at a location along the transversely extending peripheral rim between the root end and the edge of the transversely extending peripheral rim; and the peripheral rim, along the circumferential length, comprising at least one flat or substantially flat portion, the restriction hole passing through the flat or substantially flat portion.

16. The heat exchanger plate according to claim 15, wherein the portholes comprise a first outlet porthole through which the first fluid flows during the operation of the plate heat exchanger, the first inlet porthole having a flow area through which the first fluid flows during the operation of the plate heat exchanger, the first outlet porthole having a flow area through which the first fluid flows during the operation of the plate heat exchanger, the flow area of the first inlet porthole being smaller than the flow area of the first outlet porthole.

17. The heat exchanger plate according to claim 1, wherein the restriction hole is located closer to the root end of the peripheral rim than to the edge of the peripheral rim.

18. A heat exchanger plate for a plate heat exchanger configured to evaporate a first fluid during operation of the plate heat exchanger, the heat exchanger plate comprising:

a heat exchanger area extending in parallel with an extension plane of the heat exchanger plate and comprising a corrugation of ridges and valleys;

an edge area extending around the heat exchanger area;

a number of portholes extending through the heat exchanger area, the portholes comprising a first inlet porthole through which flows the first fluid during the operation of the plate heat exchanger;

a peripheral rim surrounding the first inlet porthole and extending away from the first inlet porthole in a direction transverse to the extension plane so that the peripheral rim extends from a root end of the peripheral rim adjacent the first inlet porthole to an edge of the peripheral rim, the peripheral rim having an inner peripheral surface that extends transverse to the extension plane and that surrounds a space through which the first fluid flows during the operation of the plate heat exchanger;

a portion of the inner peripheral surface of the peripheral rim that extends transverse to the extension plane being flat or substantially flat; and at least one restriction hole passing through the portion of the inner peripheral surface of the peripheral rim that is flat or substantially flat so that the at least one restriction hole opens into the space.

19. The heat exchanger plate according to claim 18, wherein the portholes comprise a first outlet porthole through which the first fluid flows during the operation of the plate heat exchanger, the first inlet porthole having a flow area through which the first fluid flows during the operation of the plate heat exchanger, the first outlet porthole having a flow area through which the first fluid flows during the operation of the plate heat exchanger, the flow area of the first inlet porthole being smaller than the flow area of the first outlet porthole.

20. The heat exchanger plate according to claim 18, wherein a portion of the inner peripheral surface of the peripheral rim that extends transverse to the extension plane being curved and possessing a radius of curvature smaller than a radius of curvature of the flat or substantially flat portion of the inner peripheral surface of the peripheral rim.

* * * * *